US010362648B2

(12) United States Patent
Mercier

(10) Patent No.: US 10,362,648 B2
(45) Date of Patent: Jul. 23, 2019

(54) OPTOELECTRONIC CIRCUIT COMPRISING LIGHT-EMITTING DIODES

(71) Applicant: Aledia, Grenoble (FR)

(72) Inventor: Frédéric Mercier, Saint Nicolas de Macherin (FR)

(73) Assignee: Aledia, Grenoble (FR)

( * ) Notice: Subject to any disclaimer, the term of this patent is extended or adjusted under 35 U.S.C. 154(b) by 8 days.

(21) Appl. No.: 15/538,631

(22) PCT Filed: Dec. 24, 2015

(86) PCT No.: PCT/FR2015/053757
§ 371 (c)(1),
(2) Date: Jun. 21, 2017

(87) PCT Pub. No.: WO2016/108022
PCT Pub. Date: Jul. 7, 2016

(65) Prior Publication Data
US 2017/0367157 A1 Dec. 21, 2017

(30) Foreign Application Priority Data
Dec. 30, 2014 (FR) ..... 14 63416

(51) Int. Cl.
*H05B 33/08* (2006.01)

(52) U.S. Cl.
CPC ..... *H05B 33/0824* (2013.01); *H05B 33/0809* (2013.01); *H05B 33/0845* (2013.01); *H05B 33/083* (2013.01)

(58) Field of Classification Search
CPC ..... H05B 33/0824; H05B 33/0809; H05B 33/083; H05B 33/0845
USPC ..... 315/291–297
See application file for complete search history.

(56) References Cited

U.S. PATENT DOCUMENTS

2011/0199003 A1* 8/2011 Muguruma ..... H05B 33/0824 315/122
2014/0176016 A1* 6/2014 Li ..... H05B 33/0803 315/307
2014/0252967 A1* 9/2014 van de Ven ..... H05B 33/0863 315/188
2014/0292217 A1* 10/2014 Shin ..... H05B 33/083 315/193

OTHER PUBLICATIONS

PCT/FR2015/053757, dated Mar. 8, 2016, International Search Report.
Written Opinion for Application No. PCT/FR2015/053757 dated Mar. 8, 2016.
International Search Report for Application No. PCT/FR2015/053757 dated Mar. 8, 2016.

* cited by examiner

*Primary Examiner* — Douglas W Owens
*Assistant Examiner* — Amy X Yang
(74) *Attorney, Agent, or Firm* — Wolf, Greenfield & Sacks, P.C.

(57) ABSTRACT

An optoelectronic circuit for receiving a variable voltage containing alternating increasing and decreasing phases, the optoelectronic circuit including a plurality of groups of light-emitting diodes and a switching device for allowing or interrupting the circulation of a current through each group, the switching device also being suitable for detecting whether said variable voltage is supplied by a dimmer.

10 Claims, 9 Drawing Sheets

OPTOELECTRONIC CIRCUIT COMPRISING LIGHT-EMITTING DIODES

CROSS-REFERENCE TO RELATED APPLICATIONS

This application is the national phase of International Application No. PCT/FR2015/053757, filed on Dec. 24, 2015, which claims priority to French Application No. 14/63416, filed on Dec. 30, 2014, which applications are incorporated herein by reference to the maximum extent allowable.

BACKGROUND

The present description relates to an optoelectronic circuit, particularly to an optoelectronic circuit comprising light-emitting diodes.

DISCUSSION OF THE RELATED ART

An optoelectronic circuit, especially used to form lighting, may be connected to a source of an AC voltage, for example, the sinusoidal voltage of the mains. To modify the luminous power supplied by the lighting circuit, it is known to place a dimmer between the source of the sinusoidal voltage and the optoelectronic circuit. There exist several types of dimmers, particularly leading edge dimmers and trailing edge dimmers.

It may be desirable to use a lighting circuit comprising light-emitting diodes. A disadvantage is that dimmers have generally been designed to operate with incandescent lamp lighting circuits and may not operate properly when they are connected to an optoelectronic circuit comprising light-emitting diodes.

SUMMARY

An object of an embodiment is to overcome all or part of the disadvantages of the previously-described optoelectronic circuits comprising light-emitting diodes powered with an AC voltage.

Another object of an embodiment is to allow a proper operation of a dimmer placed between the AC voltage source and the optoelectronic circuit.

Thus, an embodiment provides an optoelectronic circuit intended to receive a variable voltage containing an alternation of rising and falling phases, the optoelectronic circuit comprising a plurality of light-emitting diode assemblies and a switching device capable of allowing or of interrupting the flowing of a current in each assembly, the switching device being further capable of detecting whether said variable voltage is supplied by a dimmer.

According to an embodiment, the switching device is capable of connecting the assemblies of light-emitting diodes according to a plurality of connection configurations successively according to a first order during each rising phase of the variable voltage in the absence of a dimmer and a second order during each falling phase of the variable voltage in the absence of a dimmer, the switching device being further capable of detecting the presence of the dimmer when the duration of at least one connection configuration is shorter than a duration threshold and/or when at least two connection configurations follow each other according to a third order different from the first order and from the second order.

According to an embodiment, the duration threshold depends on said connection configuration.

According to an embodiment, the switching device comprises at least one switch for each assembly of light-emitting diodes, the switching device being capable of transmitting binary control signals for the turning off or the turning on of the switches according to said connection configurations, the switching device being, further, capable of determining whether the duration between the successive switching times of one of at least two control signals of two successive connection configurations is shorter than said duration threshold.

According to an embodiment, the switching device comprises, for each assembly, a comparison unit capable of comparing the voltage at one of the terminals of the assembly, and/or a voltage depending on said voltage at one of the terminals of the assembly, with at least one first voltage threshold and possibly with a second voltage threshold and a control unit connected to the comparison units and capable, during each rising phase, of interrupting the flowing of a current in each assembly from among certain assemblies of the plurality of assemblies when said voltage of said assembly rises above the second voltage threshold or when said voltage of the assembly, adjacent to said assembly and conducting the current, rises above the first voltage threshold and, during each falling phase, of controlling the flowing of a current in each assembly from among certain assemblies of the plurality of assemblies when said voltage of the assembly, adjacent to said assembly and conducting the current, decreases below the first voltage threshold.

According to an embodiment, the switching device is capable of detecting the presence of the dimmer when, for at least two assemblies, the voltages associated with the two assemblies rise above the first voltage threshold or the second voltage threshold or fall below the first voltage threshold within a duration shorter than said duration threshold.

According to an embodiment, the optoelectronic circuit comprises a current source and, for each assembly, a switch connecting the current source to said terminal of said assembly, the control unit being capable, for each assembly from among certain assemblies of the plurality of assemblies, of controlling the turning on of the switch associated with said assembly when said voltage of the assembly, adjacent to said assembly and conducting the current, falls below the first voltage threshold in each falling phase.

According to an embodiment, the switching device is further capable of detecting whether the variable voltage is supplied by a leading edge dimmer or a trailing edge dimmer.

According to an embodiment, the switching device is further capable of determining that the variable voltage is supplied by a leading edge dimmer when the duration of at least one connection configuration is shorter than a duration threshold during at least a rising phase of the variable voltage and/or when at least two connection configurations follow each other according to a fourth order different from the first order during at least a rising phase of the variable voltage and the switching device is, further, capable of determining that the variable voltage is supplied by a trailing edge dimmer when the duration of at least one connection configuration is shorter than a duration threshold during at least one falling phase of the variable voltage and/or when at least two configuration connections follow each other according to a fifth order different from the second order during at least one falling phase of the variable voltage.

According to an embodiment, the switching device is capable of at least temporarily decreasing the input impedance of the optoelectronic circuit when a dimmer is detected.

According to an embodiment, the switching device is capable of having a constant current flow through the optoelectronic circuit when a dimmer is detected.

BRIEF DESCRIPTION OF THE DRAWINGS

The foregoing and other features and advantages will be discussed in detail in the following non-limiting description of dedicated embodiments in connection with the accompanying drawings, among which.

DETAILED DESCRIPTION

Figure 1:
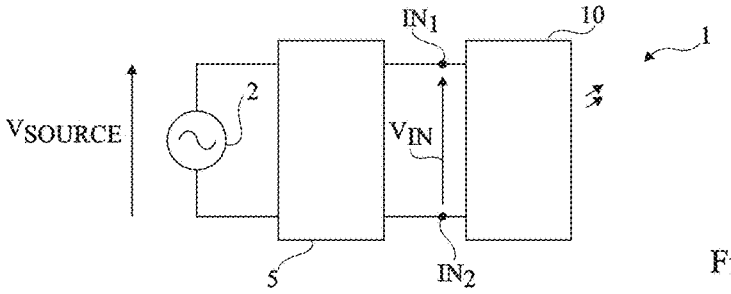
FIG. 1 is an electric diagram of an example of an optoelectronic circuit connected to a source of a sinusoidal voltage by a dimmer.

For clarity, the same elements have been designated with the same reference numerals in the various drawings and, further, the various drawings are not to scale. In the following description, unless otherwise indicated, terms "substantially", "approximately", and "in the order of" mean to within 10%, preferably to within 5%.

FIG. 1 very schematically shows an electronic system 1 comprising a source 2 of an AC voltage $V_{SOURCE}$, for example, a sinusoidal voltage, a dimmer 5 receiving AC voltage $V_{SOURCE}$ and supplying a modified AC voltage $V_{IN}$, and an optoelectronic circuit 10 comprising input terminals $IN_1$ and $IN_2$ having AC voltage $V_{IN}$ applied therebetween. As an example, input voltage $V_{SOURCE}$ may be a sinusoidal voltage having a frequency, for example, in the range from 10 Hz to 1 MHz. Voltage $V_{SOURCE}$ for example corresponds to the mains voltage.

Optoelectronic circuit 10 is capable of supplying a light signal having its luminous power depending, in particular, on voltage $V_{IN}$. Dimmer 5 may be a phase cut dimmer comprising an electronic switch having a conduction time limited to a fraction of period T of voltage $V_{SOURCE}$.

Figure 2:
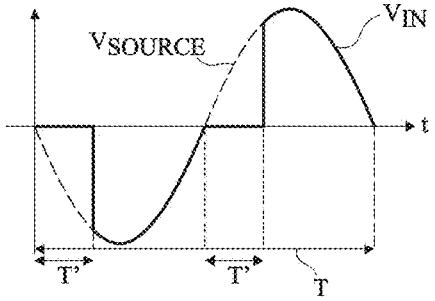
FIGS. 2 and 3 are timing diagrams of the voltage supplied by the dimmer of FIG. 1 respectively in the case of a leading edge dimmer and of a trailing edge dimmer.

FIG. 2 shows an example of a curve of the variation of voltage $V_{IN}$ when source voltage $V_{SOURCE}$ is sinusoidal with a period T and when dimmer 5 is a leading edge dimmer. Voltage $V_{IN}$ follows signal $V_{SOURCE}$ except for a time period T' at the beginning of each positive and negative sine wave arc during which voltage $V_{IN}$ is substantially zero. Leading edge dimmers may be formed with triacs.

Figure 3:
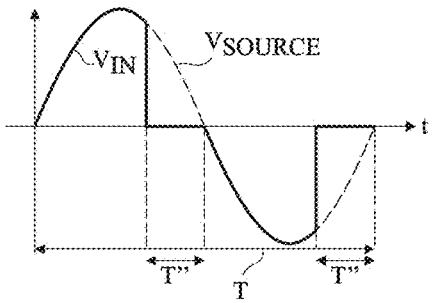

FIG. 3 shows an example of a curve of the variation of voltage $V_{IN}$ when source voltage $V_{SOURCE}$ is sinusoidal with a period T and when dimmer 5 is a trailing edge dimmer. Voltage $V_{IN}$ follows signal $V_{SOURCE}$ except for a time period T" at the end of each positive and negative sine wave arc during which voltage $V_{IN}$ is substantially zero. Trailing edge dimmers may be formed with MOS transistors.

Ratio $\alpha$ of time period T' or T" to half-period T/2 of sinusoidal signal $V_{SOURCE}$ is called firing angle of dimmer 5. A leading edge or trailing edge dimmer may comprise a variable resistance, which enables to modify firing angle $\alpha$.

It may be desirable to use light-emitting diodes to form optoelectronic circuit 10.

Figure 4:
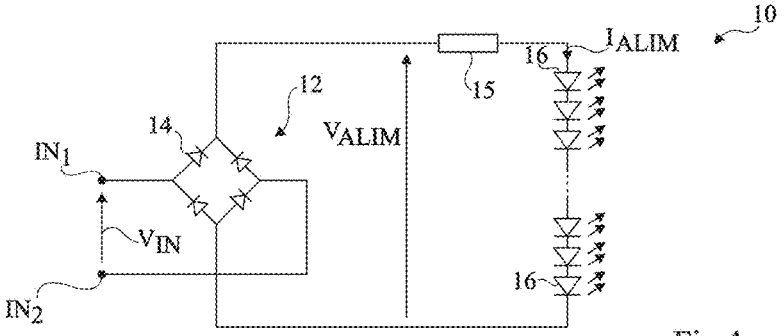
FIG. 4 is an electric diagram of an example of an optoelectronic circuit comprising light-emitting diodes capable of being connected to a source of a sinusoidal voltage.

FIG. 4 shows an example of an optoelectronic circuit 10 comprising light-emitting diodes. Optoelectronic circuit 10 comprises a rectifying circuit 12 comprising a diode bridge 14, receiving voltage $V_{IN}$ and supplying a rectified voltage $V_{ALIM}$ which powers light-emitting diodes 16, for example, series-assembled with a resistor 15. Call $I_{ALIM}$ the current flowing through light-emitting diodes 16.

Figure 5:
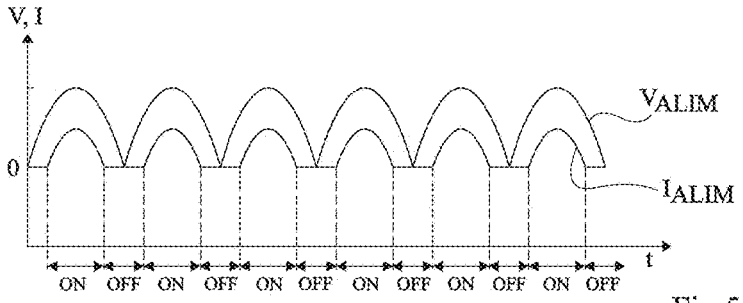
FIG. 5 is a timing diagram of the power supply current and voltage of the light-emitting diodes of the optoelectronic circuit of FIG. 4.

FIG. 5 is a timing diagram of power supply voltage $V_{ALIM}$ and of power supply current $I_{ALIM}$ for an example where AC voltage $V_{IN}$ corresponds to a sinusoidal voltage. When voltage $V_{ALIM}$ is greater than the sum of the threshold voltages of light-emitting diodes 16, light-emitting diodes 16 become conductive. Power supply current $I_{ALIM}$ then follows power supply voltage $V_{ALIM}$. There thus is an alternation of phases OFF without light emission and of light-emission phases ON.

A disadvantage is that dimmers 5 available for sale have generally been designed to operate with incandescent lamp illumination circuits and may not operate properly when they are connected to an optoelectronic circuit comprising light-emitting diodes. As an example, the proper operation of certain dimmers may require for the input impedance of optoelectronic circuit 10 seen by dimmer 5 to be low when voltage $V_{IN}$ is close to 0 V. However, in phases OFF when no light is emitted, light-emitting diodes 16 are non-conductive and optoelectronic circuit 10 then has a high input impedance, which may disturb the operation of dimmer 5.

According to an embodiment, the optoelectronic circuit comprises a device for detecting the presence or the absence of a dimmer connected to the input terminals of the optoelectronic circuit. According to an embodiment, the optoelectronic circuit further comprises a device capable of modifying certain properties of the optoelectronic circuit when a dimmer is detected, particularly to decrease the input impedance seen by the dimmer when the optoelectronic circuit is powered with a low voltage, to avoid disturbing the operation of the dimmer.

There exist optoelectronic circuits comprising a light-emitting diode switching circuit capable of progressively increasing the number of light-emitting diodes receiving power supply voltage $V_{ALIM}$ during a rising phase of the power supply voltage and of progressively decreasing the number of light-emitting diodes receiving power supply voltage $V_{ALIM}$ during a falling phase of the power supply voltage. The switching circuit is generally capable of short-circuiting a variable number of light-emitting diodes according to the variation of voltage $V_{ALIM}$. This enables to decrease the duration of each phase OFF with no light emission.

Figure 6:
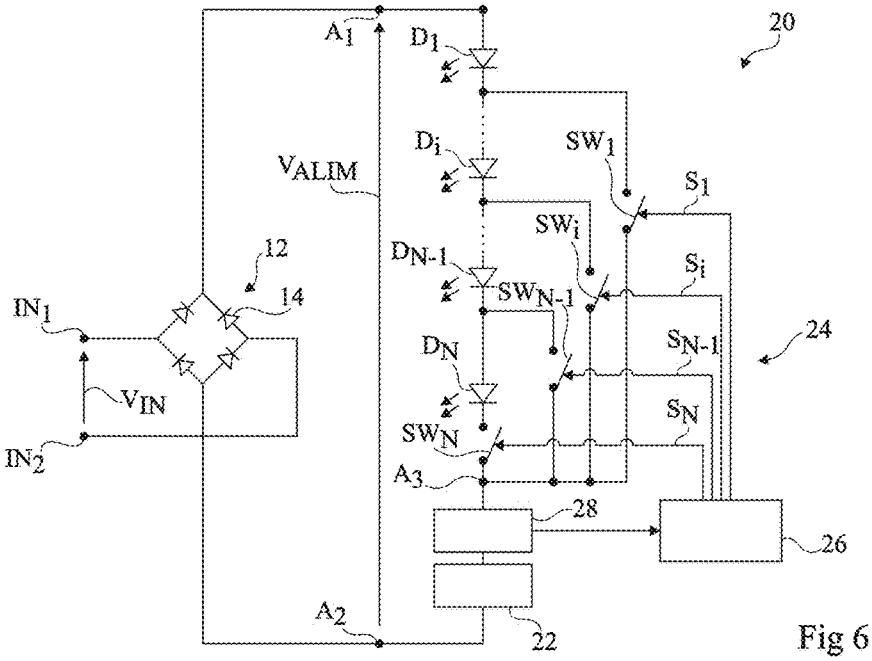
FIG. 6 is an electric diagram of an example of an optoelectronic circuit comprising light-emitting diodes comprising a light-emitting diode switching device.

FIG. 6 shows an electric diagram of an example of an optoelectronic circuit 20 comprising a light-emitting diode switching device. The elements of optoelectronic circuit 20 common with optoelectronic circuit 10 are designated with the same reference numerals. In particular, the optoelectronic circuit comprises rectifying circuit 12 receiving power supply voltage $V_{IN}$ between terminals $IN_1$ and $IN_2$ and supplying rectified voltage $V_{ALIM}$ between nodes $A_1$ and $A_2$. As a variation, circuit 20 may directly receive a rectified voltage, and it is then possible for the rectifying circuit not to be present.

Optoelectronic circuit 20 comprises N series-connected assemblies of elementary light-emitting diodes, called general light-emitting diodes $D_i$ in the following description, where i is an integer in the range from 1 to N and where N is an integer in the range from 2 to 200. Each general light-emitting diode $D_1$ to $D_N$ comprises at least one elementary light-emitting diode and is preferably formed of the series and/or parallel assembly of at least two elementary light-emitting diodes. In the present example, the N general light-emitting diodes $D_i$ are series-connected, the cathode of general light-emitting diode $D_i$ being coupled to the anode of general light-emitting diode $D_{i+1}$, for i varying from 1 to N−1. The anode of general light-emitting diode $D_1$ is coupled to node $A_1$. General light-emitting diodes $D_i$, with i varying from 1 to N, may comprise the same number of elementary light-emitting diodes or different numbers of elementary light-emitting diodes.

Optoelectronic circuit 20 comprises a current source 22 having a terminal connected to node $A_2$ and having its other terminal connected to a node $A_3$. Current source 22 may correspond to a resistor. Circuit 20 comprises a light-emitting diode switching device 24. As an example, device 24 comprises N controllable switches $SW_1$ to $SW_N$. Each switch $SW_i$, with i varying from 1 to N, is assembled between node $A_3$ and the cathode of general light-emitting diode $D_i$. Each switch $SW_i$, with i varying from 1 to N, is controlled by a signal $S_i$ supplied by a control unit 26. Control unit 26 may be totally or partly formed by a dedicated circuit or may comprise a microprocessor or a microcontroller capable of executing a series of instructions stored in a memory. As an example, signal $S_i$ is a binary signal and switch $SW_i$ is off when signal $S_i$ is in a first state, for example, the low state, and switch $SW_i$ is on when signal $S_i$ is in a second state, for example, the high state.

Optoelectronic circuit 20 comprises one or a plurality of sensors connected to control unit 26. It may be a single sensor, for example, a sensor capable of measuring voltage $V_{ALIM}$ or the current flowing between terminals $IN_1$ and $IN_2$, or a plurality of sensors, where each sensor may be associated with a general light-emitting diode $D_i$. As an example, a single sensor 28 has been shown in FIG. 6.

Control unit 26 is capable of controlling the turning on or the turning off of switches $SW_i$, with i varying from 1 to N−1, according to the value of voltage $V_{ALIM}$ according to a sequence based on the measurement of a physical parameter, for example, at least one current or one voltage. As an example, the turning off and the turning on of switches $SW_i$ may be controlled by control unit 26 based on the signals supplied by sensor 28 or the sensors. As a variation, the turning off and the turning on of switch $SW_i$ may be controlled from the measurement of the voltage at the cathode of each general light-emitting diode $D_i$. As a variation, the turning off and the turning on of switch $SW_i$ may be controlled from the measurement of voltage $V_{ALIM}$ or the measurement of the voltage at the cathode of each general light-emitting diode $D_i$. The number of switches $SW_1$ to $SW_N$ may vary according to the turn-off and turn-on sequence implemented by control unit 26. As an example, switch $SW_N$ may not be present.

Figure 7:
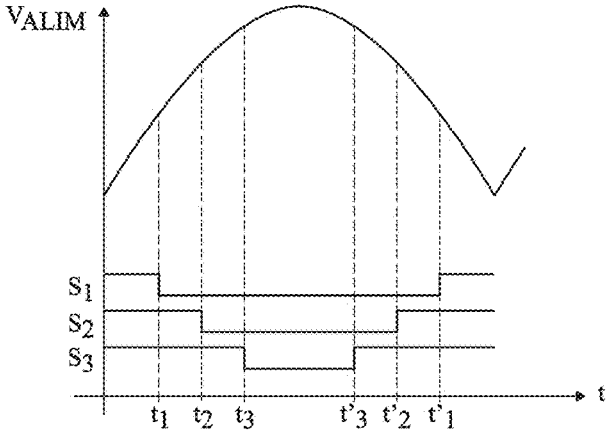
FIG. 7 is a timing diagram of signals of the optoelectronic circuit of FIG. 6.

FIG. 7 shows curves of the variation of signals $S_i$, with i varying from 1 to N−1, N being equal to 4 during a cycle of voltage $V_{ALIM}$ in the case where voltage $V_{IN}$ is a sinusoidal voltage for an example of a switching method implemented by switching device 24. As an example, at the beginning of a rising phase of voltage $V_{ALIM}$, signals $S_i$, with i varying from 1 to N−1, are initially at "1" so that switches $SW_i$ are on. Switches $SW_1$, $SW_2$, and $SW_3$ are successively turned off at times $t_1$, $t_2$, and $t_3$ along the rise of voltage $V_{ALIM}$ so that general light-emitting diodes $D_2$, $D_3$, and $D_4$ are successively powered with current. During a falling phase of voltage $V_{ALIM}$, switches $SW_3$, $SW_2$, and $SW_1$ are successively turned on at times $t'_3$, $t'_2$, and $t'_1$ to successively short-circuit general light-emitting diodes $D_4$, $D_3$, and $D_2$.

According to an embodiment, the light-emitting diode switching device is, further, capable of detecting the presence or the absence of a dimmer connected to terminals $IN_1$ and $IN_2$. The function of detecting the presence or the absence of a dimmer may advantageously be implemented with the light-emitting diode switching device already equipping certain optoelectronic circuits comprising light-emitting diodes with few modifications. An embodiment of a method of detecting the presence or the absence of a dimmer will be described with an optoelectronic circuit comprising light-emitting diodes 20, comprising a light-emitting diode switching device 24 having the structure shown in FIG. 6. It should however be clear that the method of detecting the presence or the absence of a dimmer may be implemented with other structures of light-emitting diode switching devices, particularly light-emitting diode switching devices described in patent applications US 2012/0056559, US 2008/0211421, US 2011/0273102, and U.S. Pat. No. 7,081,722.

According to an embodiment, control unit 26 is capable of comparing at least some of switching times $t_i$, that is, of turning on and/or off, switches $SW_i$, with i varying from 1 to N, during a rising phase of voltage $V_{ALIM}$ and at least some of switching times $t'_i$ of switches $SW_i$, with i varying from 1 to N, during a falling phase of voltage $V_{ALIM}$ In the absence of a dimmer, voltage $V_{ALIM}$ varies progressively during each cycle, switching times $t_i$, with i varying from 1 to N, being then different during each cycle and switching times $t'_i$ being also different during each cycle. When a dimmer is present, each cycle comprises a first phase, at the beginning or at the end of a cycle, during which voltage $V_{ALIM}$ is substantially at 0 V, and a second phase during which voltage $V_{ALIM}$ substantially follows voltage $V_{IN}$, shifted by the threshold voltages of diodes 14 of rectifying bridge 12. There thus is, during each cycle, an abrupt increase or an abrupt decrease of voltage $V_{ALIM}$ at the transition between the first and second phases. This causes the simultaneous switching of at least two switches during each cycle.

In the previously-described embodiment, a switching time $t_i$ or $t'_i$ corresponds to a time when a switch is turned off or on, that is, at a time when a binary signal $S_i$ for controlling a switch $SW_i$ switches. More generally, a switching time corresponds to a change in the configuration of the connection of light-emitting diode assemblies $D_i$, which causes a modification of the electric path followed by the current between terminals $IN_1$ and $IN_2$. A switching time can then correspond to a switching time of a binary signal supplied by a sensor to control unit 36 and/or to a switching time of a binary signal supplied by control unit 26 to a switch. In particular, when the switching times correspond to the switchings of signals supplied by sensors, according to the control method implemented by control unit 26, the fact for switching times to be simultaneous may not cause the simultaneous turning on of a plurality of switches or the simultaneous turning off of a plurality of switches. In the following description, turn-off time $t_i$ will designate a switching time in a rising phase of voltage $V_{ALIM}$ and turn-on time $t'_i$ will designate a switching time in a falling phase of voltage $V_{ALIM}$.

Figure 8:
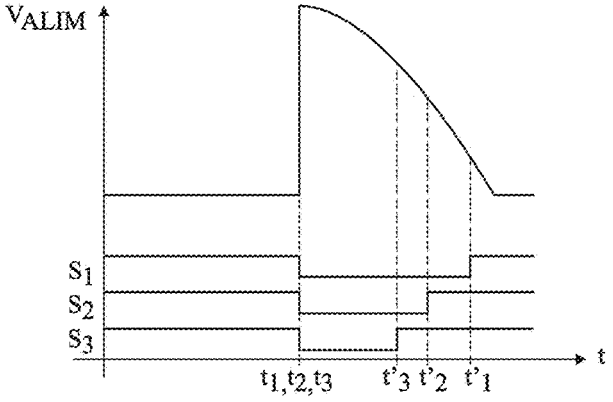
FIGS. 8 and 9 are timing diagrams of signals of the optoelectronic circuit of FIG. 6 when it is connected to a leading edge and to a trailing edge dimmer.
Figure 9:
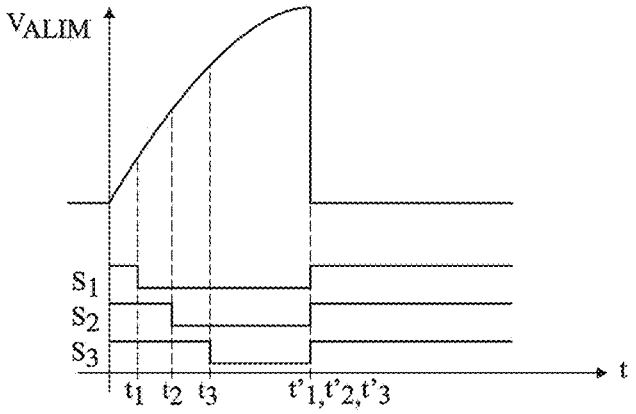

FIGS. 8 and 9 illustrate the principle of the detection of the presence or of the absence of a dimmer.

FIG. 8 is a drawing similar to FIG. 7 in the case where optoelectronic circuit 20 is connected to a leading edge dimmer with a firing angle $\alpha$ equal to 0.5. As appears in this drawing, turn-off times $t_1$, $t_2$, and $t_3$ of switches $SW_1$, $SW_2$, and $SW_3$ are substantially simultaneous. When firing angle $\alpha$ is different from 0.5, the number of switches which are simultaneously turned off may be smaller than N−1.

FIG. 9 is a drawing similar to FIG. 7 in the case where optoelectronic circuit 20 is connected to a trailing edge dimmer with a firing angle $\alpha$ equal to 0.5. As appears in this drawing, turn-on times $t'_1$, $t'_2$, and $t'_3$ of switches $SW_1$, $SW_2$, and $SW_3$ are substantially simultaneous. When firing angle $\alpha$ is different from 0.5, the number of switches which are simultaneously turned on may be smaller than N−1.

Figure 10:
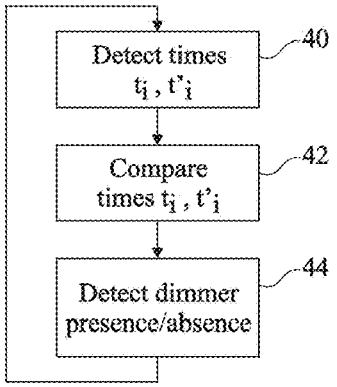
FIG. 10 shows, in the form of a block diagram, an embodiment of a method of detecting the presence or the absence of a dimmer.

FIG. 10 shows, in the form of a block diagram, an embodiment of a method of detecting the presence or the absence of a dimmer which may be used by control unit 26.

At step 40, control unit 26 determines switching times $t_i$, $t'_i$ of switching device 24 during a cycle of voltage $V_{ALIM}$. The method carries on at step 42.

At step 42, control unit 26 compares with one another at least some of turn-off times $t_i$ of switches $SW_i$ and compares with one another at least some of turn-off times $t'_i$ of switches $SW_i$. As an example, control unit 26 may compare turn-off times $t_i$ and $t_{i+1}$ and turn-on times $t'_i$ and $t'_{i+1}$. Control unit 26 may further compare at least some of turn-off times $t_i$ with at least some of turn-on times $t'_i$. The method carries on at step 44.

At step 44, according to the result of the comparison at step 42, control unit 26 determines whether a dimmer is present. If at least two turn-off times $t_i$ are close or substantially simultaneous or if at least two turn-on times $t'_i$ are close or substantially simultaneous, this means that a dimmer is present. "Close" means that the duration between the two switching times $t_i$ and $t_{i+1}$ or $t'_i$ and $t'_{i+1}$ is smaller than a duration threshold which may depend on the considered time $t_i$ or $t'_i$. In the case where turn-off times $t_i$ are not close or simultaneous and where, further, turn-on times $t_i$ are not close or simultaneous, this means that there is no dimmer. Steps 40, 42, and 44 may be at last partly carried out.

According to an embodiment, at step 44, control unit 26 is further capable of determining whether the detected dimmer is a leading edge dimmer or a trailing edge dimmer according to whether the close or simultaneous switching times are switch turn-on times or switch turn-off times. In the example of a switching method illustrated in FIGS. 8 and 9, a leading edge dimmer is detected when the simultaneous switching times are turn-off times and a trailing edge dimmer is detected when the simultaneous switching times are turn-on times.

According to an embodiment, at step 44, control unit 26 is further capable of determining firing angle $\alpha$ of the dimmer. This may in particular be performed from the determination of the time period, during a cycle of voltage $V_{ALIM}$, between the switching time (turn-on or turn-off) of a switch, which simultaneously occurs with other switching times in a rising or falling phase of voltage $V_{ALIM}$, and the switching time of this same switch which occurs in the other phase, falling or rising, of voltage $V_{ALIM}$.

Figure 11:
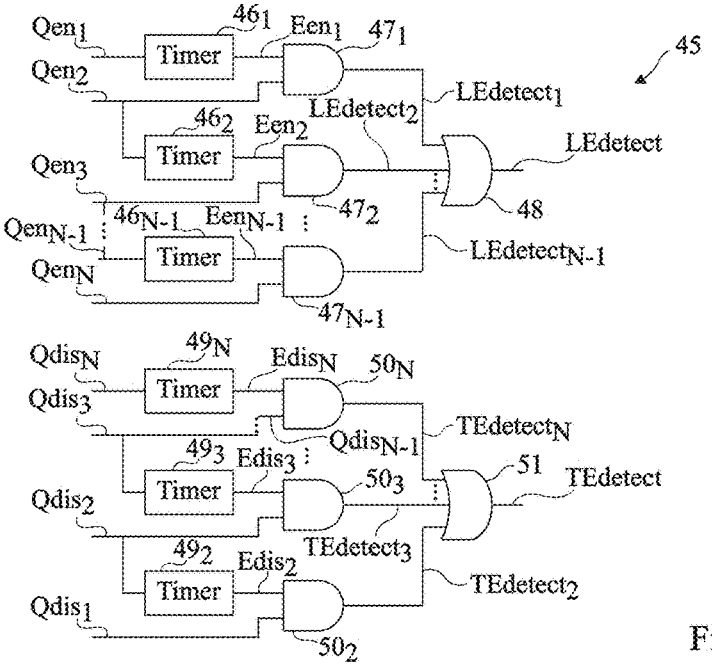
FIG. 11 partially and schematically shows an embodiment of a unit for detecting the presence or the absence of a dimmer.

FIG. 11 shows an embodiment of a unit 45 for detecting the presence or the absence of a dimmer capable of implementing the method previously described in relation with FIG. 10. Detection unit 45 may be part of control unit 26.

According to the present embodiment, unit 45 receives at least N signals $Qen_i$, with i varying from 1 to N, each signal $Qen_i$ being representative of a change of configuration of switching device 24 during a rising phase of signal $V_{ALIM}$. According to an embodiment, signal $Qen_i$ may correspond to the complementary of control signal $S_i$ of switch $SW_i$. Unit 45 further comprises N−1 timers $\mathbf{46}_i$ (Timer), with i varying from 1 to N−1. Each timer $\mathbf{46}_i$ receives signal $Qen_i$ and is activated when signal $Qen_i$ switches from "0" to "1". Each timer $\mathbf{46}_i$ supplies a binary signal $Een_i$ which switches state when a predetermined duration is reached after the activation of timer $\mathbf{46}_i$. The predetermined duration may depend on the considered timer $\mathbf{46}_i$. Unit 45 further comprises N−1 "AND" logic gates $\mathbf{47}_i$, with i varying from 1 to N−1. Each logic gate $\mathbf{47}_i$ receives signal $Een_i$ and signal $Qen_{i+1}$ and supplies a binary signal $LEdetect_i$ at "1" when signal $Een_i$ and $Qen_{i+1}$ are simultaneously at "1". Unit 45 further comprises an "OR" logic gate 48 receiving signals $LEdetect_i$, with i varying from 1 to N−1, and supplying a binary signal LEdetect which, for example, is set to "1" when at least one of signals $LEdetect_i$, with i varying from 1 to N−1, is at "1" and which is set to "0" when all signals $LEdetect_i$, with i varying from 1 to N−1, are at "0".

When the duration between at least two turn-off times $t_i$ and $t_{i+1}$ is shorter than the duration measured by timer $\mathbf{46}_i$, signal $LEdetect_i$ is set to "1" and signal LEdetect is set to "1". This means the detection of a leading edge dimmer.

According to the present embodiment, unit 45 receives at least N signals $Qdis_i$, with i varying from 1 to N, each signal $Qdis_i$ being representative of a change of configuration of switching device 24 during a falling phase of signal $V_{ALIM}$ According to an embodiment, signal $Qdis_i$ may correspond to control signal $S_i$ of switch $SW_i$. Unit 45 further comprises N−1 timers $\mathbf{49}_i$, with i varying from 2 to N. Each timer $\mathbf{49}_i$ receives signal $Qdis_i$ and is activated when signal $Qdis_i$ switches from "0" to "1". Each timer $\mathbf{49}_i$ supplies a signal $Edis_i$ which switches state when a predetermined duration is reached after the activation of timer $\mathbf{49}_i$. The predetermined duration may depend on the considered timer $\mathbf{49}_i$. Unit 45 further comprises N−1 "AND" logic gates $\mathbf{50}_i$, with i varying from 2 to N. Each logic gate $\mathbf{50}_i$ receives signal $Edis_i$ and signal $Qdis_{i-1}$ and supplies a binary signal $TEdetect_i$ at "1" when signal $E_i$ and $Qdis_{i+1}$ are simultaneously at "1". Unit 45 further comprises an "OR" logic gate 51 receiving signals $TEdetect_i$, with i varying from 2 to N, and supplying a binary signal TEdetect which, for example, is set to "1" when at least one of signals $TEdetect_i$, with i varying from 2 to N, is at "1", and which is set to "0" when all signals $TEdetect_i$, with i varying from 2 to N, are at "0". A trailing edge dimmer is detected when signal TEdetect is at "1".

When the duration between at least two turn-on times $t'_i$ and $t'_{i+1}$ is shorter than the duration measured by timer $\mathbf{49}_{i+1}$, signal $TEdetect_{i+1}$ is set to "1" and signal TEdetect is set to "1". This means the detection of a trailing edge dimmer.

According to an embodiment, the duration measured by each timer $\mathbf{46}_i$ or $\mathbf{49}_i$ is the same for each timer $\mathbf{46}_i$ or $\mathbf{49}_i$. According to an embodiment, the duration measured by each timer $\mathbf{46}_i$ or $\mathbf{49}_i$ depends on the timer $\mathbf{46}_i$ or $\mathbf{49}_i$. According to an embodiment, the duration measured by each timer $\mathbf{46}_i$ or $\mathbf{49}_i$ is smaller than the theoretical duration expected between times $t_i$ and $t_{i+1}$ or between times $t'_i$ and $t'_{i+1}$ in the absence of a dimmer. The theoretical duration may be determined from the knowledge of the maximum amplitude and frequency of signal $V_{ALIM}$ and on the number of light-emitting diodes of each light-emitting diode assembly $D_i$.

The embodiment shown in FIG. 11 may advantageously be achieved by a digital circuit or an analog circuit. In the case of a digital circuit, timer $\mathbf{46}_i$, $\mathbf{49}_i$ may be rated by a clock signal. In the case of an analog circuit, timer $\mathbf{46}_i$, $\mathbf{49}_i$ may comprise a capacitor charged at constant current.

According to another embodiment, the unit for detecting the presence or the absence of a dimmer is capable of storing the successive times $t_i$ and $t'_i$. This enables, advantageously at previously-described step 44, to compare more than two turn-off times $t_i$, more than two turn-on times $t'_i$ and/or turn-off times $t_i$ with turn-on times $t'_i$. To store successive times $t_i$ and $t'_i$, a timer which is for example activated at switching time $t_1$ and stopped at switching time $t'_1$ may be used. The duration between times $t_1$ and $t'_1$ is representative, in the absence of a dimmer, of the period of voltage $V_{ALIM}$.

Advantageously, the previously-described embodiments of methods of detecting the presence or the absence of a dimmer may be implemented with known optoelectronic circuits comprising a light-emitting diode switching device, with no other modification than the addition of the detection unit.

Figure 12:
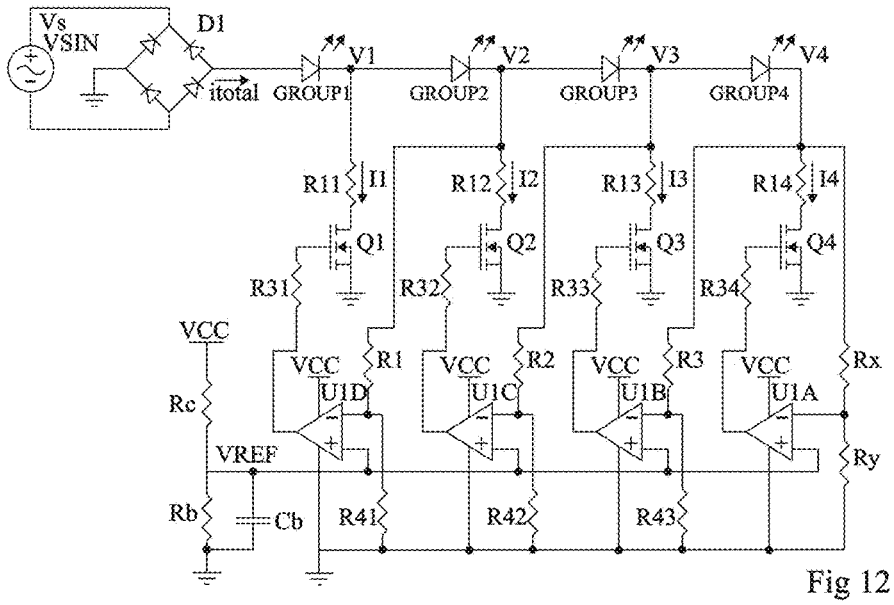
FIG. 12 is an electric diagram of another example of an optoelectronic circuit comprising light-emitting diodes comprising a light-emitting diode switching device.

FIG. 12 corresponds to FIG. 5 of U.S. Pat. No. 7,081,722 which is herein incorporated by reference. FIG. 12 shows an embodiment of an optoelectronic circuit comprising a light-emitting diode switching device with which the previously-described embodiments of the method of detecting the presence or the absence of a dimmer may be implemented. Indeed, signals $Qen_i$, previously described in relation with FIG. 11, may correspond to the complementaries of the signals for controlling the gates of MOS transistors Qi, with i varying from 1 to 4, of FIG. 12 and signals $Qdis_i$, previously-described in relation with FIG. 11, may correspond to the signals for controlling the gates of MOS transistors Qi, with i varying from 1 to 4.

Figure 13:
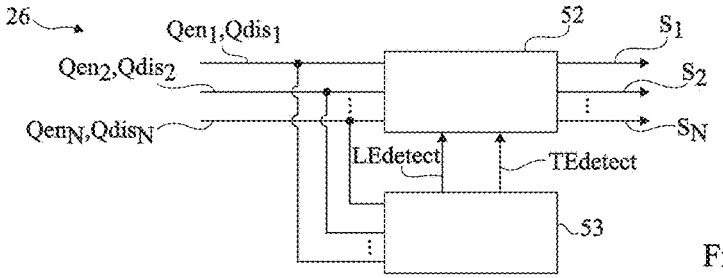
FIG. 13 schematically shows an embodiment of a control unit of a light-emitting diode switching device.

FIG. 13 shows an embodiment of control unit 26 of optoelectronic circuit 20. Control unit 26 comprises a processing unit 52 and a unit 53 for detecting the presence or the absence of a dimmer. Processing unit 52 receives signals and/or signals $Qen_i$ and is capable of supplying control signals $S_i$, with i varying from 1 to N. Detection unit 53 receives signals $Qen_i$ and/or signals $Qdis_i$ and supplies signals LEdetect and TEdetect to processing unit 52.

Figure 14:
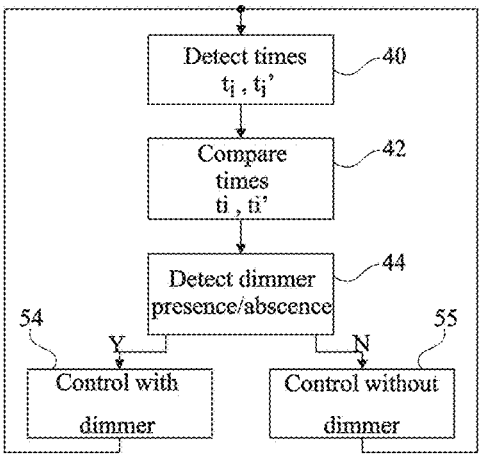
FIG. 14 shows, in the form of a block diagram, an embodiment of a method of controlling a light-emitting diode switching device.

FIG. 14 shows, in the form of a block diagram, where an embodiment of a method of controlling a light-emitting diode switching device capable of being implemented by control unit 26 shown in FIG. 13. The control method comprises previously-described steps 40, 42, 44. At step 44, if detection unit 53 has detected the presence of a dimmer, the method carries on at step 54. At step 44, if detection unit 53 has not detected the presence of a dimmer, the method carries on at step 55.

At step 54, processing unit 52 may control a first operating mode adapted to the presence of a dimmer. According to an embodiment, the first operating mode comprises decreasing the input impedance of the optoelectronic circuit seen by the dimmer when no light-emitting diode is conducting. According to an embodiment, a first operating mode comprises maintaining a current flowing between terminals $IN_1$ and $IN_2$ permanently above a current threshold which may be adapted to the proper operation of the dimmer. According to an embodiment, a first operating mode comprises permanently maintaining a constant current between terminals $IN_1$ and $IN_2$. The method carries on at step 40.

At step 55, control unit 26 may control a second adapted operating mode when a dimmer is not present, which for example corresponds to the normal operating mode of switching device 22. The method carries on at step 40.

Steps 40 to 55 may be implemented for each cycle of voltage $V_{ALIM}$, one cycle out of two, one cycle out of ten, etc.

According to an embodiment, at the start, the optoelectronic circuit may operate according to the first operating mode before the first implementation of the method of detecting the presence or the absence of a dimmer. Thereby, if the presence of a dimmer is confirmed at step 44, the optoelectronic circuit is already in the first operating mode. Risks of a poor operation of the dimmer at the start are thus advantageously avoided.

The first operating mode implemented at step 54 may depend on the type of detected dimmer. As an example, in the first operating mode, when a current flowing between terminals $IN_1$ and $IN_2$ is permanently maintained above a current threshold, the current threshold may depend on the type of detected dimmer.

The first operating mode implemented at step 54 may depend on the determined firing angle $\alpha$. As an example, in the first embodiment, when a constant current is maintained between terminals $IN_1$ and $IN_2$, the current level may depend on the determined firing angle $\alpha$.

Figure 15:
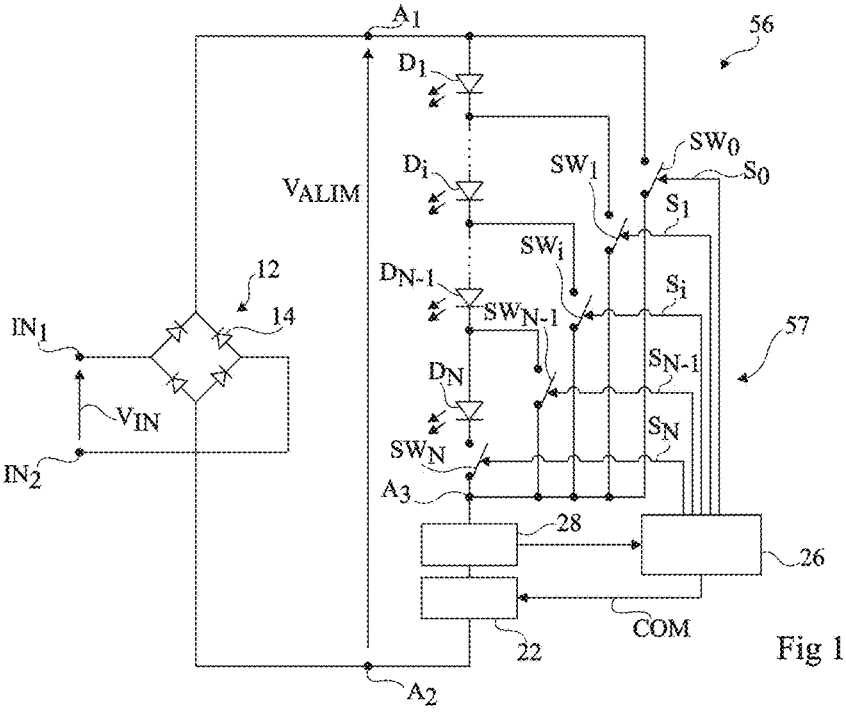
FIG. 15 is an electric diagram of an embodiment of an optoelectronic circuit comprising light-emitting diodes, comprising a dimmer detection device.

FIG. 15 shows an embodiment of an optoelectronic circuit 56 comprising a light-emitting diode switching device 57 capable of detecting the presence or the absence of a dimmer connected to terminals $IN_1$ and $IN_2$ and further capable, in the first operating mode, of decreasing the input impedance of optoelectronic circuit 56 seen by the dimmer. Optoelectronic circuit 56 comprises all the elements of optoelectronic circuit 20 shown in FIG. 6 and further comprises an additional switch $SW_0$ connecting nodes $A_1$ and $A_3$, controlled by a binary signal $S_0$ supplied by control unit 26. According to an embodiment, at previously-described step 55, in the second operating mode, in the absence of detection of a dimmer, switch $SW_0$ is left permanently off. At previously-described step 54, in the first operating mode, when a dimmer is detected, switch $SW_0$ is turned on at the beginning and at the end of each cycle of voltage $V_{ALIM}$. According to an embodiment, unit 26 may control, at the beginning of a cycle of voltage $V_{ALIM}$, the turning off of switch $SW_0$ when the signal measured by sensor 28 exceeds a threshold, and control, at the end of a cycle of voltage $V_{ALIM}$, the turning on of switch $SW_0$, while switch $SW_1$ is on, when the signal measured by sensor 28 decreases below a threshold. When switch $SW_0$ is turned on at the beginning and at the end of the cycle of voltage $V_{ALIM}$, a current may flow between input terminals $IN_1$ and $IN_2$ as soon as voltage $V_{ALIM}$ is different from zero. Optoelectronic circuit 56 thus has a low input impedance between input terminals $IN_1$ and $IN_2$ at the beginning and at the end of the cycle of voltage $V_{ALIM}$. A dimmer connected to input terminals $IN_1$ and $IN_2$ can then operate properly.

According to an embodiment, current source 22 is a controllable current source and control unit 26 supplies a control signal COM to current source 22 in order to control the current source to modify the current supplied by current source 22 in the first operating mode. According to an embodiment, current source 22 may be controlled to supply a constant current for each cycle of voltage $V_{ALIM}$ while a dimmer is detected.

Figure 16:
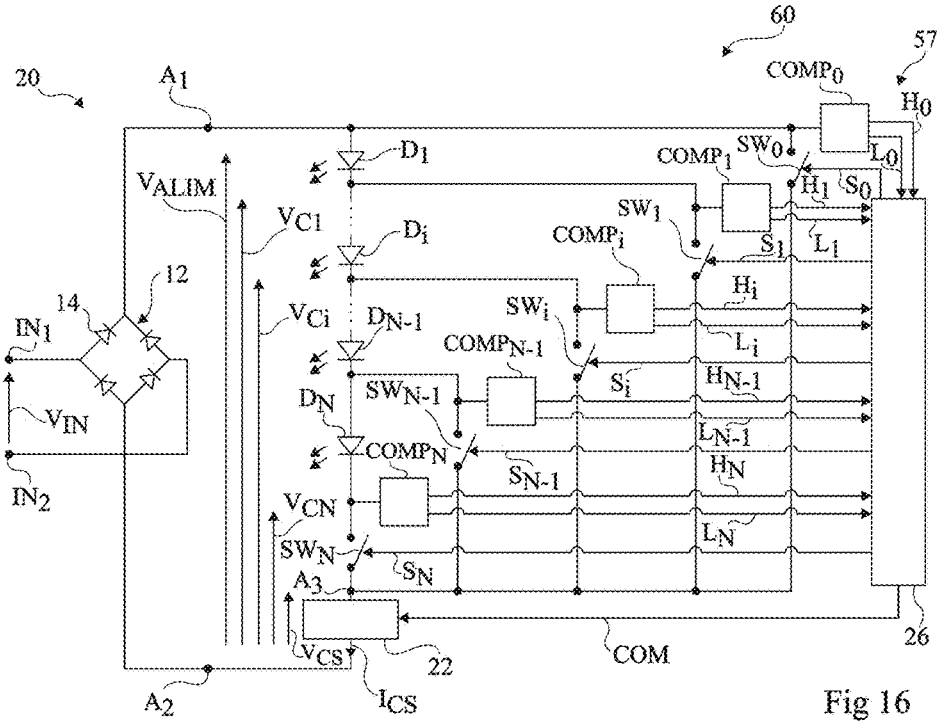
FIG. 16 shows a more detailed embodiment of an optoelectronic circuit comprising light-emitting diodes, comprising a dimmer detection device.

FIG. 16 shows a more detailed electric diagram of an embodiment of an optoelectronic circuit 60. The elements common between optoelectronic circuit 60 and optoelectronic circuit 20 are designated with the same reference numerals.

Call $V_{CS}$ the voltage across current source 22 and $I_{CS}$ the current supplied by current source 22. Optoelectronic circuit 60 may comprise a circuit, not shown, for supplying a reference voltage to power current source 22, possibly obtained from voltage $V_{ALIM}$. For i varying from 1 to N, call $V_{Ci}$ the voltage between the cathode of general light-emitting diode $D_i$ and node $A_2$. Further, voltage $V_{ALIM}$ is also called $V_{C0}$. In the following description, unless otherwise mentioned, the voltages are referenced to node $A_2$.

Optoelectronic circuit 60 further comprises N+1 comparison units $COMP_i$, with i varying from 0 to N, capable of each receiving voltage $V_{Ci}$ and of supplying a signal $H_i$ and a signal $L_i$. Control unit 26 receives signals $L_0$ to $L_N$ and Ho to $H_N$ and supplies signals $S_0$ to $S_N$ for controlling switches $SW_0$ to $SW_N$.

The elementary light-emitting diodes of each general light-emitting diode $D_i$, with i varying from 1 to N are, for example, planar light-emitting diodes, each comprising a stack of layers resting on a planar surface, having at least one active layer capable of emitting light. The elementary light-emitting diodes are, for example, planar light emitting diodes or light-emitting diodes formed from three-dimensional semiconductor elements, particularly microwires, nanowires, or pyramids, for example comprising a semiconductor material based on a compound mainly comprising at least one group-III element and one group-V element (for example, gallium nitride GaN), called III-V compound hereafter, or mainly comprising at least one group-II element and one group-VI element (for example, zinc oxide ZnO), called II-VI compound hereafter. Each three-dimensional semiconductor element is covered with at least one active layer capable of emitting light.

For i varying from 0 to N, switch $SW_i$ is, for example, a switch based on at least one transistor, particularly a field-effect metal-oxide gate transistor or enrichment (normally on) or depletion (normally off) MOS transistor.

In the present embodiment, control unit 26 is capable of controlling the turning on or off of switches $SW_i$, with i varying from 0 to N, according to the value of voltage $V_{Ci}$. To achieve this, each comparison unit $COMP_i$, with i varying from 0 to N, is capable of comparing voltage $V_{Ci}$ with at least two thresholds $Vhigh_i$ and $Vlow_i$. As an example, signal $L_i$ is a binary signal which is in a first state when voltage $V_{Ci}$ is smaller than threshold $Vlow_i$ and which is in a second state when voltage $V_{Ci}$ is greater than threshold $Vlow_i$. As an example, signal $H_i$ is a binary signal which is in a first state when voltage $V_{Ci}$ is smaller than threshold $Vhigh_i$ and which is in a second state when voltage $V_{Ci}$ is greater than threshold $Vhigh_i$. The first states of binary signals $H_i$ and $L_i$ may be equal or different and the second states of binary signals $H_i$ and $L_i$ may be equal or different.

Figure 17:
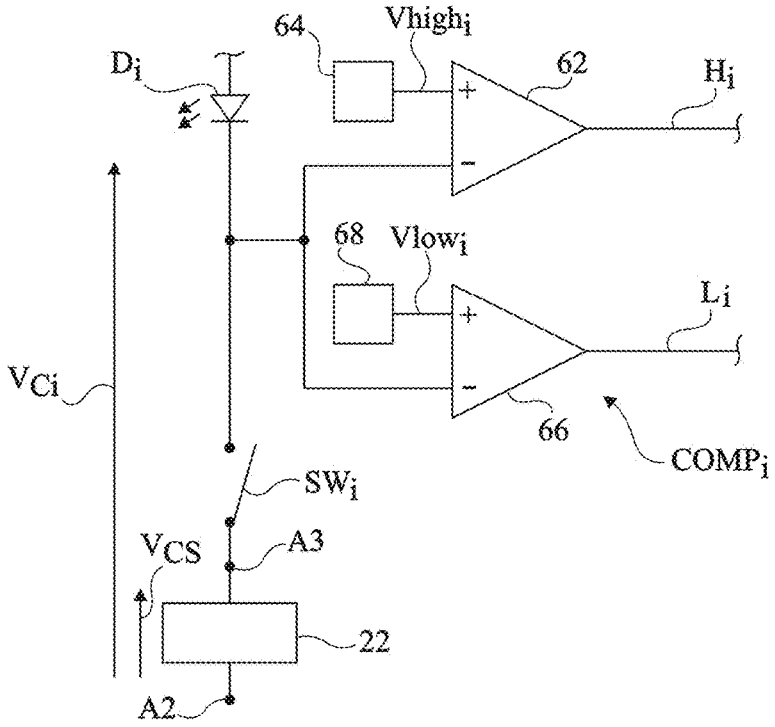
FIGS. 17 and 18 are more detailed electric diagrams of embodiments of portions of the optoelectronic circuit of FIG. 16.

FIG. 17 shows an electric diagram of a more detailed embodiment of a portion of electronic circuit 60. According to the present embodiment, each comparator $COMP_i$ comprises a first operational amplifier 62, operating as a comparator. The inverting input (−) of operational amplifier 62 is connected to the cathode of general light-emitting diode $D_i$, for i varying from 1 to N and to node $A_l$ for comparator $COMP_0$. The non-inverting input (+) of operational amplifier 62 receives voltage threshold $Vhigh_i$ which is supplied by a unit 64, which may comprise a memory. Operational amplifier 62 supplies signal $H_i$. Each comparator $COMP_i$ further comprises a second operational amplifier 66 operating as a comparator. The inverting input (−) of operational amplifier 66 is connected to the cathode of general light-emitting diode $D_i$, for i varying from 1 to N and to node $A_1$ for comparator $COMP_0$. The non-inverting input (+) of operational amplifier 66 receives voltage threshold $Vlow_i$ which is supplied by a unit 68, which may comprise a memory. Operational amplifier 66 supplies signal $L_i$.

Figure 18:
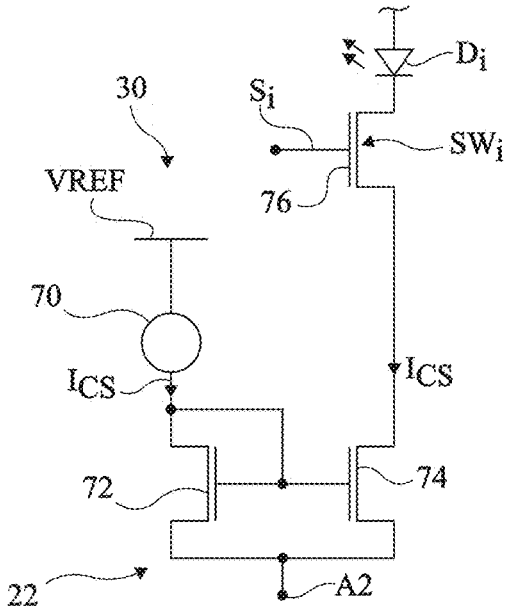

FIG. 18 shows an electric diagram of a more detailed embodiment of current source 22 and of switch $SW_i$. In the present embodiment, current source 22 comprises an ideal current source 70 having a terminal connected to a first source of a reference voltage VREF. The other terminal of current source 70 is connected to the drain of a diode-assembled N-channel MOS transistor 72. The source of MOS transistor 72 is connected to node $A_2$. The gate of MOS transistor 72 is connected to the drain of MOS transistor 72. Reference potential VREF may be supplied from voltage $V_{ALIM}$. It may be constant or vary according to voltage $V_{ALIM}$. The intensity of the current supplied by current source 22 may be constant or be variable, for example, vary according to voltage $V_{ALIM}$.

For each general light-emitting diode $D_i$, current source 22 comprises an N-channel MOS transistor 74 having its gate connected to the gate of transistor 72 and having its source connected to node $A_2$. MOS transistors 72 and 74 form a current mirror, current $I_{CS}$ supplied by current source 70 being copied, possibly with a multiplication factor.

According to the present embodiment, switch $SW_i$ comprises an N-channel MOS transistor 76 having its drain connected to the cathode of general light-emitting diode $D_i$ and having its source connected to the drain of transistor 74. The voltage applied to the gate of transistor 76 corresponds to previously-described signal $S_i$.

Figure 19:
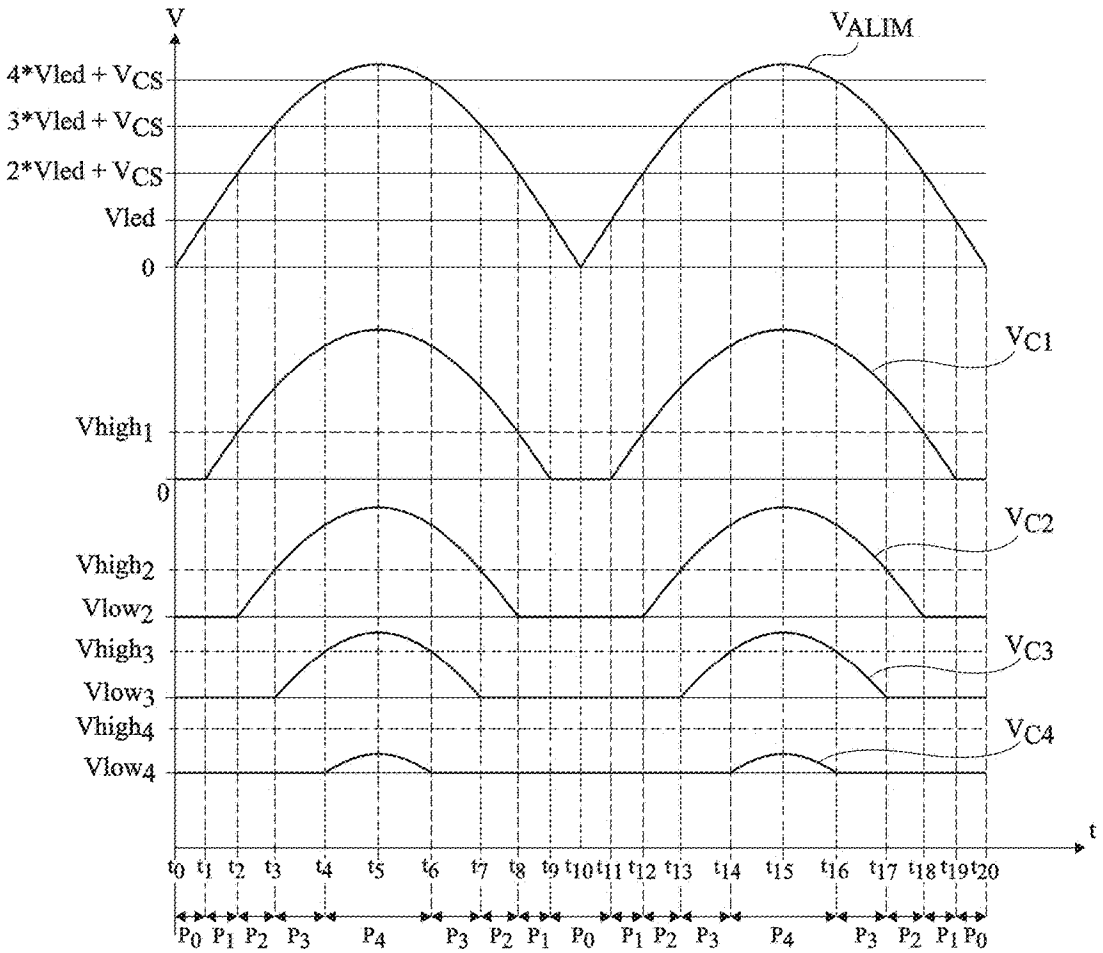
FIG. 19 is a timing diagram of voltages of the optoelectronic circuit of FIG. 16.

FIG. 19 shows timing diagrams of power supply voltage $V_{ALIM}$, equal to voltage $V_{C0}$, and of the voltages $V_{Ci}$ measured by each comparator $COMP_i$, with i varying from 1 to N, illustrating the operation of optoelectronic circuit 60 according to the embodiment shown in FIG. 16 in the case where N is equal to 4 and in the case where each general light-emitting diode $D_i$ comprises the same number of elementary light-emitting diodes arranged in the same configuration, and thus has the same threshold voltage Vled. As an example, voltage $V_{ALIM}$ supplied by rectifying bridge 12 is a rectified sinusoidal voltage comprising a succession of cycles having voltage $V_{ALIM}$ increasing from the zero value, crossing a maximum value, and decreasing to the zero value, in each of them. As an example, two successive cycles of voltage $V_{ALIM}$ are shown in FIG. 19.

An embodiment will now be described for the second embodiment in the absence of detection of a dimmer. Call $t_0$ to $t_{20}$ successive times.

At time $t_0$, at the beginning of a cycle when a dimmer is not detected, switch $SW_1$ is turned on and all switches $SW_i$, with i varying from 2 to N, are turned off. Voltage $V_{ALIM}$ rises from the zero value and distributes between general light-emitting diode $D_1$, switch $SW_1$, and current source 22. Voltage $V_{ALIM}$ being smaller than threshold voltage Vled of general light-emitting diode $D_1$, there is no light emission (phase $P_0$) and voltage $V_{C1}$ remains substantially equal to zero.

At time $t_1$, when the voltage across general light-emitting diode $D_1$ exceeds threshold voltage Vled, general light-emitting diode $D_1$ becomes conductive (phase $P_1$). The voltage across general light-emitting diode $D_1$ then remains substantially constant and voltage $V_{C1}$ keeps on increasing along with voltage $V_{ALIM}$. As soon as power supply voltage $V_{C1}$ is sufficiently high to allow the activation of current source 22, current $I_{CS}$ flows through the general light-emitting diode $D_1$ which emits light. As an example, voltage $V_{CS}$, when current source 22 is in operation, is preferably substantially constant.

At time $t_2$, when voltage $V_{C1}$ exceeds threshold $Vhigh_i$, unit 26 successively controls the turning on of switch $SW_2$ and then the turning off of switch $SW_1$. Voltage $V_{ALIM}$ then distributes between general light-emitting diodes $D_1$ and $D_2$, switch $SW_2$, and current source 22. Preferably, threshold $Vhigh_i$ is substantially equal to the sum of the threshold voltage of general light-emitting diode $D_2$ and of operating voltage $V_{CS}$ of current source 22 so that, at the turning on of switch $SW_2$, general light-emitting diode $D_2$ conducts current $I_{CS}$ and emits light. The fact for switch $SW_2$ to be turned on before the turning off of switch $SW_i$ ensures that there will be no interruption of the current flow in general light-emitting diode $D_1$. Phase $P_2$ corresponds to a phase of light emission by general light-emitting diodes $D_1$ and $D_2$.

Generally, when a dimmer is not detected, during a rising phase of power supply voltage $V_{ALIM}$, for i varying from 1 to N−1, while switch $SW_i$ is on and the other switches are off, unit 26 successively controls the turning on of switch $SW_{i+1}$ and the turning off of switch $SW_i$ when voltage $V_{Ci}$ exceeds threshold $Vhigh_i$. Voltage $V_{ALIM}$ then distributes between general light-emitting diodes $D_1$ to $D_{i+1}$, switch $SW_{i+1}$, and current source 22. Preferably, threshold $Vhigh_i$ is substantially equal to the sum of the threshold voltage of general light-emitting diode $D_{i+1}$ and of operating voltage $V_{CS}$ of current source 22 so that, at the turning on of switch $SW_{i+i}$, general light-emitting diode $D_{i+1}$ conducts current $I_{CS}$ and emits light. Phase $P_{i+1}$ corresponds to the emission of light by general light-emitting diodes $D_1$ à $D_{i+1}$. The fact for switch $SW_{i+1}$ to be turned on before the turning off of switch $SW_i$ ensures that there will be no interruption of the current flow in general light-emitting diodes $D_1$ to $D_i$.

Thus, at time $t_3$, unit 26 controls the turning on of switch $SW_3$ and the turning off of switch $SW_2$. Phase $P_3$ corresponds to the emission of light by general light-emitting diodes $D_1$, $D_2$, and $D_3$. At time $t_4$, unit 26 controls the turning on of switch $SW_4$ and the turning off of switch $SW_3$. Phase $P_4$ corresponds to the emission of light by general light-emitting diodes $D_1$, $D_2$, $D_3$, and $D_4$.

Power supply voltage $V_{ALIM}$ reaches its maximum value at time $t_5$ during phase $P_4$ in FIG. 19 and starts a falling phase.

At time $t_6$, when voltage $V_4$ decreases below threshold $Vlow_4$, unit 26 successively controls the turning on of switch $SW_3$ and the turning off of switch $SW_4$. Voltage $V_{ALIM}$ then distributes between general light-emitting diodes $D_1$, $D_2$, and $D_3$, switch $SW_3$, and current source 22. Preferably, threshold $Vlow_4$ is selected to be substantially equal to the sum of operating voltage $V_{CS}$ of current source 22 and of the minimum operating voltage of switch $SW_4$ so that, at the turning on of switch $SW_3$, there is no interruption of the current flow.

Generally, during a falling phase of power supply voltage $V_{ALIM}$, when a dimmer is not detected, for i varying from 2 to N, when voltage $V_{Ci}$ decreases below threshold $Vlow_i$, unit 26 successively controls the turning on of switch $SW_{i-1}$ and the turning off of switch $SW_i$. Voltage $V_{ALIM}$ then distributes between general light-emitting diodes $D_1$ to $D_{i-1}$, switch $SW_{i-1}$, and current source 22. Preferably, threshold $Vlow_i$ is selected to be substantially equal to the sum of operating voltage $V_{CS}$ of current source 22 and of the minimum operating voltage of switch $SW_i$ so that, at the turning on of switch $SW_{i-1}$, there is no interruption of the current flow.

Thus, at time $t_7$, unit 26 controls the turning on of switch $SW_2$ and the turning off of switch $SW_3$. At time $t_8$, unit 26 controls the turning on of switch $SW_2$ and the turning off of switch $SW_1$. At time $t_9$, voltage $V_{C1}$ becomes zero so that general light-emitting diode $D_1$ is no longer conductive and current source 22 is off. At time $t_{10}$, voltage $V_{ALIM}$ becomes zero and a new cycle starts. Times $t_{11}$ to $t_{20}$ are respectively similar to times $t_1$ to $t_{10}$. In the present embodiment, comparator $COMP_1$ may have a simpler structure than comparators $COMP_i$, with i varying from 2 to N, since threshold $Vlow_i$ is not used.

In the case where a leading edge dimmer is present, voltage $V_{ALIM}$ is zero at the beginning of a cycle and then abruptly increases. During such an abrupt increase, at least two comparators $COMP_i$ and COMP simultaneously switch signals $H_i$ and $H_j$. If k is the highest index of comparator $COMP_k$ which switches signal $H_k$, control unit 26 successively controls the turning on of switch $SW_{k+1}$ and then the turning off of all switches $SW_0$ to $SW_k$.

In the case where a trailing edge dimmer is present, voltage $V_{ALIM}$ abruptly decreases during a cycle and then remains substantially zero until the end of the cycle. During such an abrupt decrease, at least two comparators $COMP_i$ and COMP simultaneously switch signals $L_i$ and $L_j$. If k is the highest index of comparator $COMP_k$ which switches signal $L_k$, control unit 26 successively controls the turning on of switch $SW_{k-1}$ and then the turning off of all switches $SW_{k+1}$ to $SW_N$.

In the first operating mode, when a dimmer is detected, switch $SW_0$ is turned on at the end and at the beginning of each cycle, for example, as long as the voltage across general light-emitting diode $D_1$ is smaller than threshold voltage Vled, the other switches being off.

In the first embodiment, control unit 26 may further control current source 22 as previously described.

According to another embodiment of optoelectronic circuit 60, each comparator $COMP_i$ of optoelectronic circuit 60 only supplies signal $L_i$. An advantage of this embodiment is that the structure of comparator $COMP_i$ can be simplified. Indeed, it is possible for comparator $COMP_i$ not to comprise operational amplifier 62.

The operation of the optoelectronic circuit according to this other embodiment is then identical to what has been previously described, with the difference that switches $SW_i$, with i varying from 0 to N−1 in the first embodiment, with i varying from 1 to N−1 in the second embodiment, are initially on and that, in a rising phase of power supply voltage $V_{ALIM}$, switch $SW_{i-1}$ is turned off when voltage $V_{Ci}$ becomes greater than threshold $Vlow_i$. Indeed, this means that current starts flowing through switch $SW_i$.

More specifically, in a rising phase of power supply voltage $V_{ALIM}$, while light-emitting diodes $D_1$ to $D_{i-1}$ are conductive and light-emitting diodes $D_i$ to $D_N$ are off, when voltage $V_{Ci}$ falls below threshold $Vlow_i$, unit 26 controls the turning off of $SW_{i-i}$. Indeed, a rise in voltage $V_{Ci}$ means that the voltage across light-emitting diode $D_i$ becomes greater than the threshold voltage of light-emitting diode $D_i$ and that the latter becomes conductive.

The operation of the optoelectronic circuit according to this other embodiment in a falling phase of power supply voltage $V_{ALIM}$ may be identical to that which has been previously described for optoelectronic circuit 60.

Figure 20:
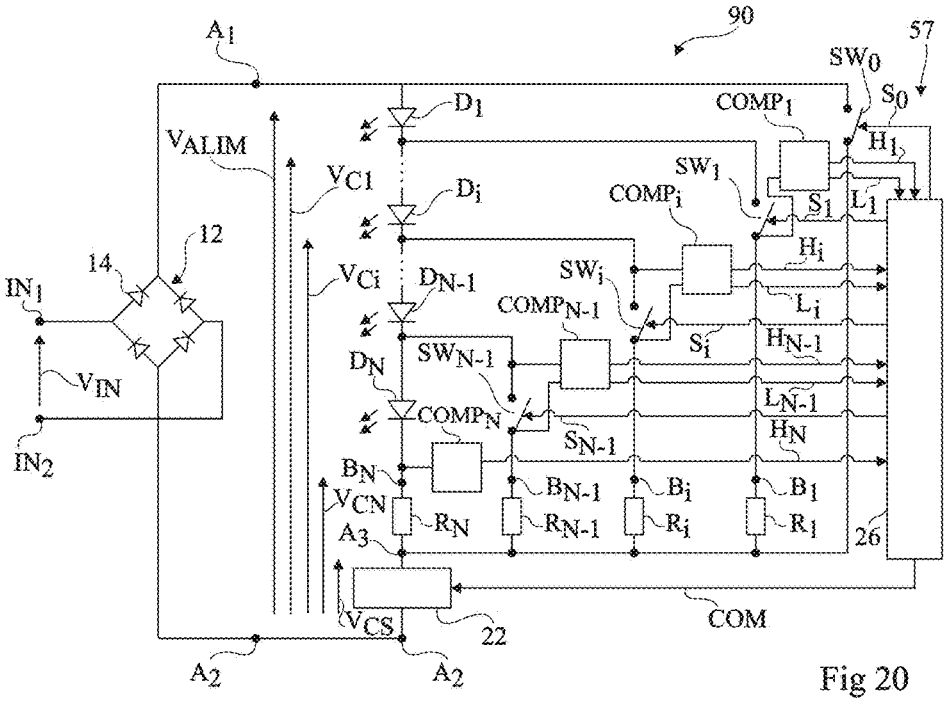
FIG. 20 shows an electric diagram of another embodiment of an optoelectronic circuit comprising light-emitting diodes comprising a dimmer detection device.

FIG. 20 shows an electric diagram of another embodiment of an optoelectronic circuit 90. All the elements common with optoelectronic circuit 60 are designated with the same reference numerals. Unlike optoelectronic circuit 60, optoelectronic circuit 90 does not comprise switch $SW_N$. Further, unlike optoelectronic circuit 60, for i varying from 1 to N−1, optoelectronic circuit 90 comprises a resistor $R_i$ provided between node $A_3$ and switch $SW_i$, and optoelectronic circuit 90 comprises a resistor $R_N$ provided between node $A_3$ and the cathode of general light-emitting diode $D_N$. Call $B_i$ a node between resistor $R_i$ and switch $SW_i$, for i varying from 1 to N−1, and $B_N$ a node between resistor $R_N$ and the cathode of general light-emitting diode $D_N$. Further, each comparator $COMP_i$, with i varying from 1 to N, further receives the voltage at node $B_i$. Signal $H_i$ then is a binary signal which is in a first state when the voltage at node $B_i$ is smaller than a threshold $MIN_i$ and which is in a second state when the voltage at node $B_i$ is greater than threshold $MIN_i$. A resistor $R_0$ may be provided in series with switch $SW_0$.

Comparator $COMP_i$ and resistor $R_i$ may be replaced with any device capable of determining whether a current greater than a current threshold flows through the branch comprising switch $SW_i$. According to an embodiment, a current mirror is arranged on the branch comprising $SW_i$ to copy the current flowing through switch $SW_i$. The copied current can then be compared with a current threshold.

Figure 21:
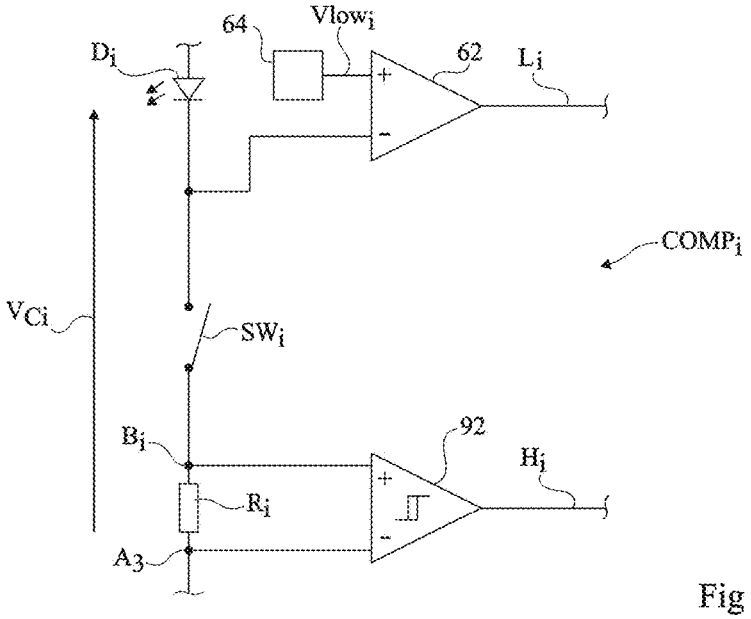
FIGS. 21 and 22 are drawings respectively similar to FIGS. 17 and 18 and show electric diagrams of more detailed embodiments of portions of the optoelectronic circuit of FIG. 20.

FIG. 21 shows an electric diagram of a more detailed embodiment of a portion of optoelectronic circuit 90. In the present embodiment, comparator $COMP_i$ comprises all the elements of comparator $COMP_i$ shown in FIG. 17, with the difference that operational amplifier 66 is replaced with a hysteresis comparator 92 receiving the voltage across resistor $R_i$ and supplying signal $H_i$.

Figure 22:
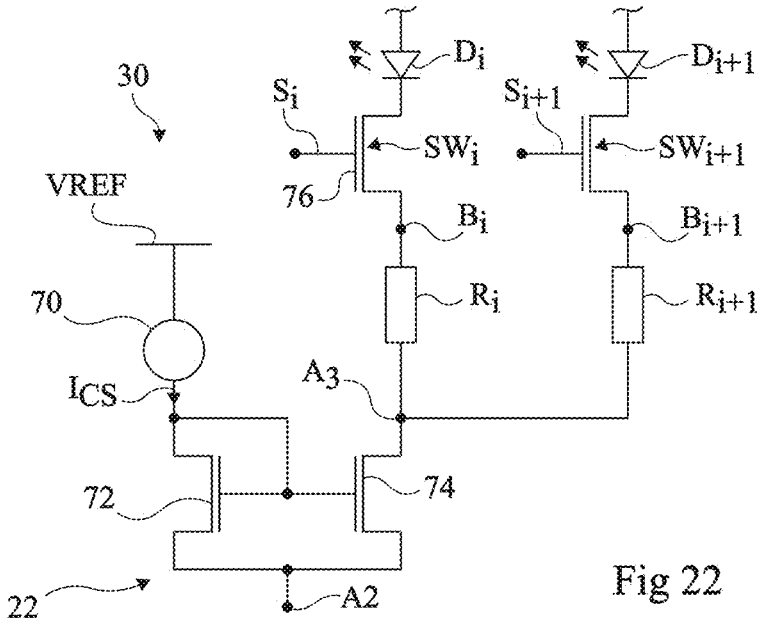

FIG. 22 shows an electric diagram of a more detailed embodiment of current source 22 and of switch $SW_i$ for optoelectronic circuit 90. Current source 22 comprises all the elements of the current source shown in FIG. 18. Resistor $R_i$ is interposed between MOS transistor 74 and node $B_i$, a terminal of resistor $R_i$ being connected to the drain of transistor 74 and the other terminal of resistor $R_i$ being connected to node $B_i$.

The operation of optoelectronic circuit 90 may be identical to the operation of previously-described optoelectronic circuit 60 with the difference that, in a rising phase of power supply voltage $V_{ALIM}$, switch $SW_i$ is turned off when current starts flowing through resistor $R_{i+1}$.

More specifically, switches $SW_i$, with i varying from 1 to N−1, are initially on, switch $SW_0$ being off in the second operating mode when a dimmer is not detected and being on in the first operating mode when a dimmer is detected. In a rising phase of power supply voltage $V_{ALIM}$, for i varying from 1 to N−1, while light-emitting diodes $D_1$ to $D_{i-1}$ are conductive and light-emitting diodes $D_i$ to $D_N$ are off, when the voltage across light-emitting diode $D_i$ becomes greater than the threshold voltage of light-emitting diode $D_i$, the latter becomes conductive and a current starts flowing through resistor $R_i$. This results in a rise in the voltage at node $B_i$. As soon as the voltage at node $B_i$ rises above threshold $MIN_i$, unit 26 controls the turning on of switch $SW_{i-i}$.

The operation of optoelectronic circuit 90 in a falling phase of power supply voltage $V_{ALIM}$ may be identical to that which has been previously described for optoelectronic circuit 60.

Optoelectronic circuit 90 has the advantage that thresholds $MIN_i$ and $Vlow_i$ can be independent from the characteristics of light-emitting diodes $D_i$. In particular, they do not depend on the threshold voltage of each light-emitting diode $D_i$.

Various embodiments with various variations have been described hereabove. It should be noted that those skilled in the art may combine various elements of these various embodiments and variations without showing any inventive step.

The invention claimed is:

1. An optoelectronic circuit intended to receive a variable voltage containing an alternation of rising and falling phases, the optoelectronic circuit comprising a plurality of light-emitting diode assemblies and a switching device capable of allowing or of interrupting the flowing of a current in each assembly, the switching device being further capable of detecting whether said variable voltage is supplied by a dimmer wherein the switching device is capable of connecting the assemblies of light-emitting diodes according to a plurality of connection configurations successively according to a first order during each rising phase of the variable voltage in the absence of a dimmer and a second order during each falling phase of the variable voltage in the absence of a dimmer, the switching device being further capable of detecting the presence of the dimmer when the duration of at least one connection configuration is shorter than a duration threshold and/or when at least two connection configurations follow each other according to a third order different from the first order and from the second order.

2. The optoelectronic circuit of claim 1, wherein the duration threshold depends on said at least one connection configuration.

3. The optoelectronic circuit of claim 1, wherein the switching device comprises at least one switch for each assembly of light-emitting diodes, the switching device being capable of transmitting binary control signals for the turning off or the turning on of the switches according to said connection configurations, the switching device being, further, capable of determining whether the duration between the successive switching times of one of two control signals of two successive connection configurations is shorter than said duration threshold.

4. The optoelectronic circuit of claim 1, wherein the switching device comprises, for each assembly, a comparison unit capable of comparing the voltage at one of the terminals of the assembly, and/or a voltage depending on said voltage at one of the terminals of the assembly, with at least one first voltage threshold and possibly with a second voltage threshold and a control unit connected to the comparison units and capable, during each rising phase, of interrupting the flowing of a current in each assembly from among certain assemblies of the plurality of assemblies when said voltage of said assembly rises above the second voltage threshold or when said voltage of the assembly, adjacent to said assembly and conducting the current, rises above the first voltage threshold and, during each falling phase, of controlling the flowing of a current in each assembly from among certain assemblies of the plurality of assemblies when said voltage of the assembly, adjacent to said assembly and conducting the current, decreases below the first voltage threshold.

5. The optoelectronic circuit of claim 4, wherein the switching device is capable of detecting the presence of the dimmer when, for at least two assemblies, the voltages associated with the two assemblies rise above the first voltage threshold or the second voltage threshold or fall below the first voltage threshold within a duration shorter than said duration threshold.

6. The optoelectronic circuit of claim 4, comprising a current source and, for each assembly, a switch connecting the current source to said terminal of said assembly, and wherein the control unit is capable, for each assembly from among certain assemblies of the plurality of assemblies, of controlling the turning on of the switch associated with said assembly when said voltage of the assembly, adjacent to said assembly and conducting the current, falls below the first voltage threshold in each falling phase.

7. The optoelectronic circuit of claim 1, wherein the switching device is further capable of detecting whether the variable voltage is supplied by a leading edge dimmer or a trailing edge dimmer.

8. The optoelectronic circuit of claim 7, wherein the switching device is further capable of determining that the variable voltage is supplied by a leading edge dimmer when the duration of at least one connection configuration is shorter than a duration threshold during at least a rising phase of the variable voltage and/or when at least two connection configurations follow each other according to a fourth order different from the first order during at least a rising phase of the variable voltage and wherein the switching device is further capable of determining that the variable voltage is supplied by a trailing edge dimmer when the duration of at least one connection configuration is shorter than a duration threshold during at least one falling phase of the variable voltage and/or when at least two configuration connections follow each other according to a fifth order different from the second order during at least one falling phase of the variable voltage.

9. The optoelectronic circuit of claim 1, wherein the switching device is capable of at least temporarily decreasing an input impedance of the optoelectronic circuit when a dimmer is detected.

10. The optoelectronic circuit of claim 1, wherein the switching device is capable of having a constant current flow through the optoelectronic circuit when a dimmer is detected.

* * * * *